United States Patent [19]

Hamada

[11] 4,414,308

[45] Nov. 8, 1983

[54] SILVER HALIDE COLOR PHOTOGRAPHIC PHOTOSENSITIVE MATERIAL

[75] Inventor: Fumio Hamada, Hino, Japan

[73] Assignee: Konishiroku Photo Industry Co., Ltd., Tokyo, Japan

[21] Appl. No.: 358,685

[22] Filed: Mar. 16, 1982

[30] Foreign Application Priority Data

Mar. 20, 1981 [JP] Japan ..... 56-42117
Dec. 3, 1981 [JP] Japan ..... 56-195317

[51] Int. Cl.[3] ..... G03C 1/40

[52] U.S. Cl. ..... 430/505; 430/506; 430/509; 430/544; 430/957

[58] Field of Search ..... 430/505, 509, 544, 957, 430/506

[56] References Cited

U.S. PATENT DOCUMENTS 3,620,747 11/1971 Marchant et al. ..... 430/509
4,184,876 1/1980 Eeles et al. ..... 430/505
4,248,962 2/1981 Lau ..... 430/558
4,283,472 8/1981 Gompf et al. ..... 430/17

*Primary Examiner*—J. Travis Brown
*Attorney, Agent, or Firm*—Frishauf, Holtz, Goodman & Woodward

[57] ABSTRACT

In a silver halide color photographic photosensitive material, having a red, a green and a blue light-sensitive emulsion layer on a support, each emulsion containing a nondiffusible image forming coupler, improvement is attained by providing a layer structure in which at least one of the red, the green and the blue light-sensitive emulsion layer is separated into a high sensitivity silver halide emulsion layer and a low sensitivity silver halide emulsion layer, both layers having photosensitive regions in substantially the same spectral region, by an intermediate layer and incorporating at least one kind of DIR compounds represented by formula (I) defined in the specification in at least one layer of the high sensitivity silver halide emulsion layer, the low sensitivity silver halide emulsion and the intermediate layer.

9 Claims, No Drawings

SILVER HALIDE COLOR PHOTOGRAPHIC PHOTOSENSITIVE MATERIAL

This invention relates to a silver halide photographic photosensitive material, particularly to a silver halide color photographic photosensitive material for photographing excellent in sensitivity, graininess as well as stability in developing treatment.

There have been made a great number of proposals to obtain a color photographic photosensitive material having a high sensitivity with decreased sizes of grains.

For example, British Patent No. 923,045 discloses a material in which a high sensitivity emulsion layer containing a diffusion-resistant coupler capable of color forming in substantialy the same color phase is coated separately from a low sensitivity emulsion layer, and further the color forming concentration of the high sensitivity emulsion layer is controlled to a low level, whereby sensitivity can be enhanced without deterioration of graininess.

However, in recent years, there is an increasing desire to have a color photographic material with further enhanced sensitivity and for that purpose experts are obliged to use gross silver halide grains in a high sensitivity emulsion layer or to use a coupler of increased coupling speed. For this reason, according to the method disclosed in British Patent No. 923,045, no satisfactory graininess can be obtained and hence further efforts have been made in order to satisfy both the requirements of sensitivity and graininess.

For example, Japanese Patent Publication No. 15495/1974 discloses a method in which there is provided a gelatin layer or a medium sensitivity emulsion layer between the aforesaid high sensitivity emulsion layer and the low sensitivity emulsion layer. However, according to this method, in spite of the satisfactory results as to sensitivity and graininess, no good color reproduction is possible due to great changes or loss of balance in densities of respective layers of yellow, magenta and cyan with the changes in development conditions such as pH value, temperature and time during developing, as experienced by the present inventors.

Accordingly, the object of the present invention is to provide a silver halide color photographic photosensitive material for photographing having a high sensitivity which is excellent in graininess as well as in stability during development.

The present inventors have made extensive studies for solving the above task and consequently found that it can be accomplished by a silver halide color photographic photosensitive material, comprising a red sensitive emulsion layer, a gree sensitive emulsion layer and a blue sensitive emulsion layer on a support, each emulsion containing a nondiffusible image forming coupler, being characterized in that at least one of the red light-sensitive emulsion layer, the green light-sensitive emulsion layer and the blue light-sensitive emulsion layer is separated into a high sensitivity silver halide emulsion layer and a low sensitivity silver halide emulsion layer, both layers having photosensitive regions in substantially the same spectral region, by an intermediate layer (hereinafter referred to as the intermediate layer according to the present invention), and further at least one kind of DIR compounds represented by formula (I) shown below is incorporated in at least one layer of said high sensitivity silver halide emulsion layer, said low sensitivity silver halide emulsion and the intermediate layer according to the present invention:

$$\text{A-TIME-Z} \qquad \text{(I)}$$

wherein A is a coupling component capable of reacting with an oxidized product of a color forming developing agent and releasing a TIME-Z group on reaction with an oxidized product of a color forming developing agent; TIME is a timing group; and Z is a development inhibitor.

That is, according to the present invention, there is made an attempt to solve the above task by providing a novel color photographic photosensitive material with employment of the layer structure and the DIR compound having a timing group (hereinafter referred to as T-DIR compound) as specified above.

The present invention is now described in detail below.

In the present invention, there are provided a high sensitivity emulsion layer and a low sensitivity emulsion layer with the intermediate layer according to the present invention interposed therebetween. Said intermediate layer according to the present invention may contain in addition to gelatin a coupler, a hydroquinone derivative, a non-color-forming coupler, fine grains of a silver halide having substantially no effective sensitivity and a silver halide emulsion photosensitive to the light in substantially the same spectral region as the high sensitivity and low sensitivity emulsion layers. More preferably, the intermediate layer according to the present invention is desired to contain no photosensitive silver halide emulsion.

To describe now in further detail about the intermediate layer according to the present invention, when the intermediate layer according to the present invention provided between a high sensitivity emulsion layer and the low sensitivity emulsion layer is non-photosensitive in the present invention, said high sensitivity emulsion layer and low sensitivity emulsion layer may be each constituted of one layer. More preferably, each emulsion layer may be constituted of two or more layers, whereby the effect as described in the aforesaid British Patent No. 923,045 can be further added to the effect of the present invention. When a coupler is added in the intermediate layer according to the present invention, the effect of the present invention can preferably be increased.

Further, it is also preferred to provide a high sensitivity emulsion layer farther from a support than a low sensitivity emulsion layer.

When the intermediate layer according to the present invention provided between a high sensitivity emulsion layer and a low sensitivity emulsion layer contains a photosensitive silver halide photosensitive to substantially the same spectral region as the high sensitivity and low sensitivity emulsion layer, said intermediate layer according to the present invention may preferably contain a silver halide emulsion having a medium sensitivity between those of the high sensitivity and low sensitivity layers.

In the present invention, the high sensitivity emulsion layer or the intermediate layer according to the present invention containing a coupler or a photosensitive silver halide is desired to have a maximum color forming density ratio, in terms of the ratio relative to the low sensitivity emulsion layer as being 1, in the range of from 0.02 to 0.7, preferably from 0.05 to 0.6.

The difference in sensitivity between the high sensitivity emulsion layer and the low sensitivity emulsion layer may be determined optimally by the method known in the art in view of the desired gradation and graininess characteristics, but it is generally desired to have a difference in the range of from 0.1 to 1.0 log E (E: dosage of exposure). On the other hand, when the intermediate layer according to the present invention is a medium sensitivity silver halide emulsion layer, it is desired to have a sensitivity difference in the range of from 0.1 to 0.9 log E, particularly preferably from 0.3 to 0.7 log E.

Referring now to the T-DIR compound to be used in the present invention, it can be represented by formula (I):

A-TIME-Z (I).

In the formula, A is a coupling component reactive with an oxidized product of a color forming developing agent and it can be any desired component, so far it can liberate a TIME-Z group on reaction with an oxidized product of a color forming developing agent.

Typical examples of TIME-may incude those either from intramolecular nucleophilic substitution reactions as disclosed in Japanese Provisional Patent Publication No. 145135/1979 or from electron transfers along the conjugated chains as disclosed in Japanese Patent Application No. 17644/1980. Namely, it is possible to use any compound which can liberate first a TIME-Z group through cleavage of a A-TIME bonding and then a Z group through cleavage of a TIME-Z group. The group Z contains a development inhibitor as disclosed in Research Disclosure vol. 176, No. 17643, Dec., 1978 (hereinafter referred to as Literature 1), including preferably mercaptotetrazole, selenotetrazole, mercaptobenzothiazole, selenobenzothiazole, mercaptobenzooxazole, selenobenzooxazole, mercaptobenzimidazole, selenobenzimidazole, benzotriazole, benzodiazole and derivatives of these compounds.

More specifically, the T-DIR compounds to be used in the present invention may include the compounds represented by formula (II), (III), (IV) or (V) shown below:

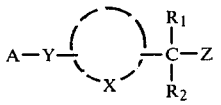
(II)

wherein A and Z have the same meanings as defined in formula (I), X represents a group of atoms necessary for completion of a benzene ring or a naphthalene ring; each of $R_1$ and $R_2$ represents a hydrogen atom, an alkyl group or an aryl group; and Y represents —S—, —O— or

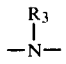

($R_3$ represents a hydrogen atom, an alkyl group, an acyl group or a sulfonic group, or may form a condensed ring together with $R_1$, said group of

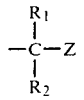

being substituted at the ortho- or para-position relative to Y;

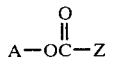
(III)

wherein A and Z have the same meanings as defined in formula (I);

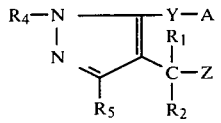
(IV)

wherein A and Z have the same meanings as defined in formula (I); Y, $R_1$ and $R_2$ have the same meanings as defined in formula (II); $R_4$ is a hydrogen atom, an alkyl group, an aryl group, an acyl group, a sulfonic acid group, an alkoxycarbonyl group or a heterocyclic residue; and $R_5$ is a hydrogen atom, an alkyl group, an aryl group, an alkoxy group, an amino group, an acidamide group, a sulfonamide group, a carboxyl group, an alkoxycarbonyl group, a carbamoyl group, or a cyano group;

and DIR compounds of the type liberating inhibitors by intramolecular nucleophilic substitution represented by formula (V):

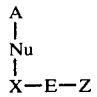
(V)

wherein A and Z have the same meanings as defined in formula (I) and Nu-X-E corresponds to TIME, Nu being a nucleophilic group having an oxygen atom, a sulfur atom or a nitrogen atom which is enriched in electrons; E an electrophilic group having a carbonyl group, a thiocarbonyl group, a phosphinyl group or a thiophosphinyl group which is depleted in electrons, which electrophilic group being bonded to Z; and X a bonding group which binds Nu and E in steric association with each other and can liberate Z after liberation of Nu from A through an intramolecular nucleophilic substitution reaction with formation of a three- or seven-membered ring.

Among the T-DIR compounds represented by formula (V), those wherein Nu is —O—, —S— or $>NR_3$, X is

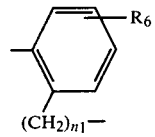

($n_1$—0 or 1 or —$(CH_2)_{n2}$—($n_2$=2 or 3) and E is

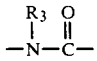

are found to further enhance the effect of the present invention. In the above formula, $R_6$ represents a hydrogen atom, an alkyl group, an aryl group, an alkoxy group, an amide group, a carboxyl group, an alkoxycarbonyl group, a carbamoyl group, a cyano group, a nitro group or a halogen atom.

In the following, there are enumerated typical examples of specific T-DIR compounds to be used in the present invention, but the compounds to be used in the present invention are not limited thereto.

Exemplary compounds:

[T - 1]

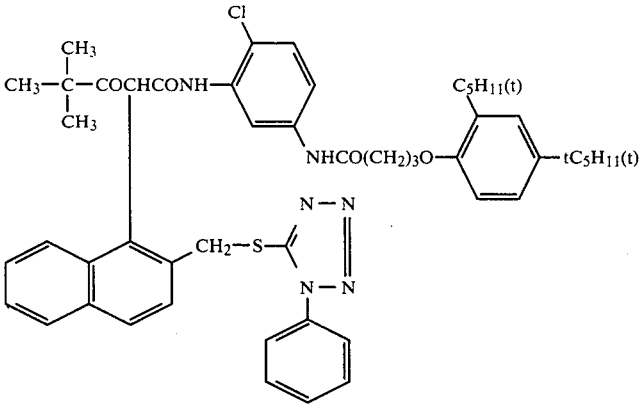

[T - 2]

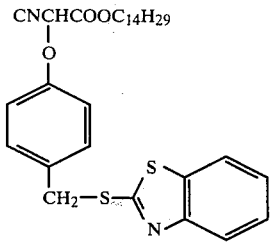

[T - 3]

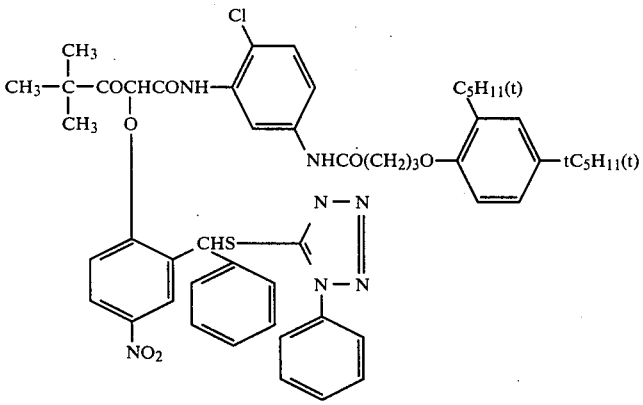

[T - 4]

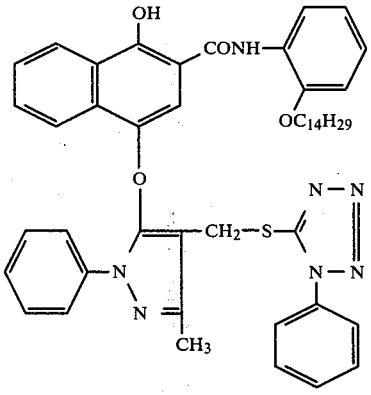

[T - 5]

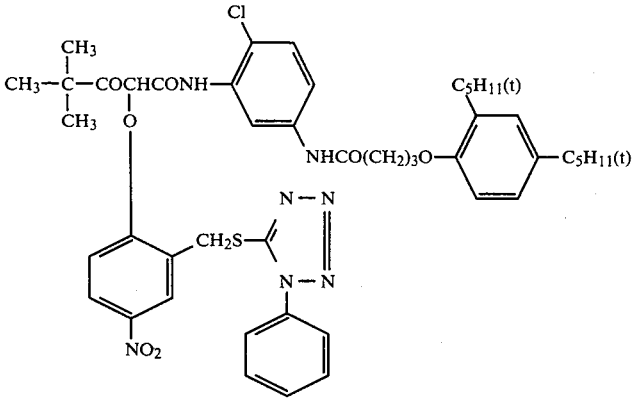

[T - 6]

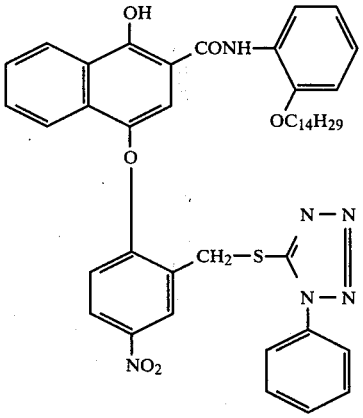

-continued
[T - 7]
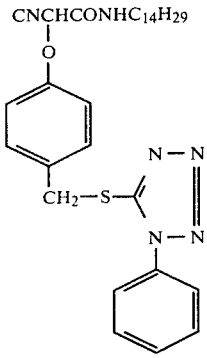
[T - 8]
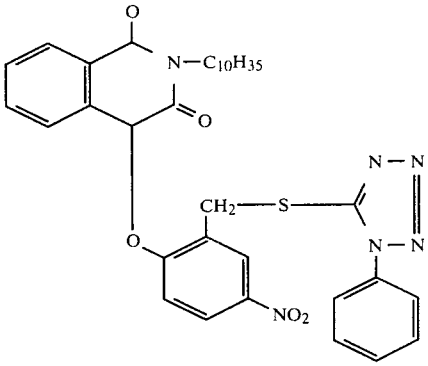
[T - 9]
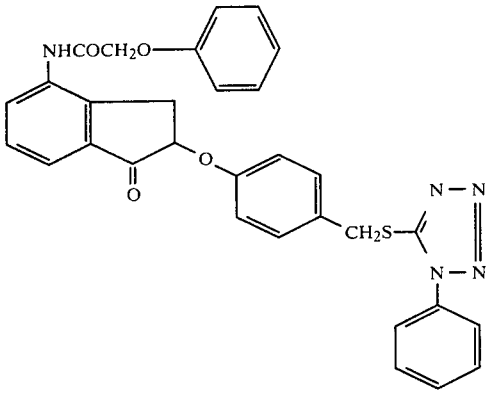
[T - 10]
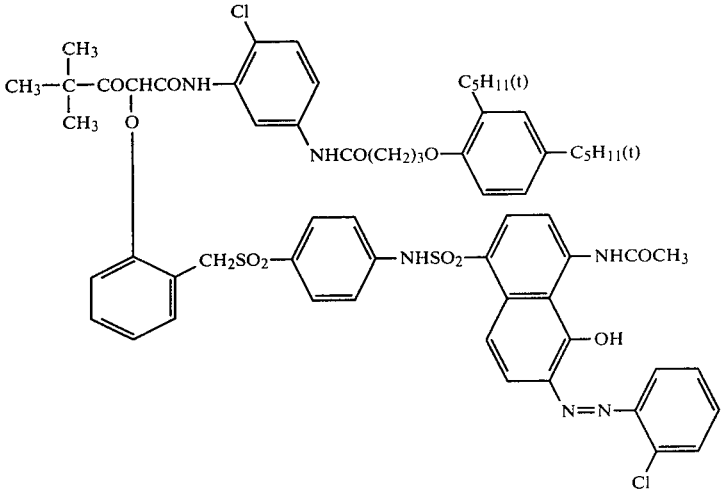

-continued
[T - 11]
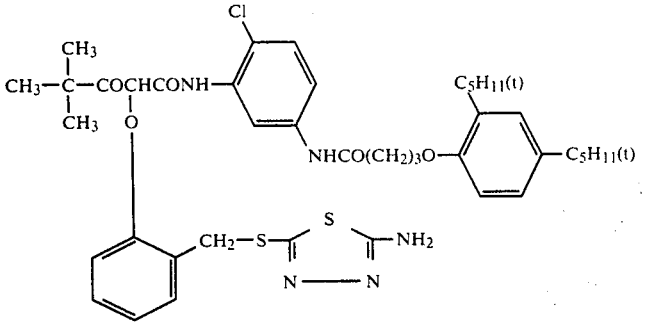
[T - 12]
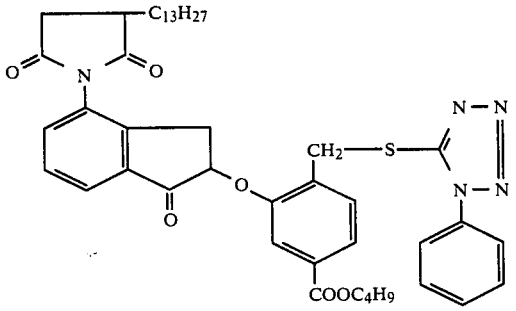
[T - 13]
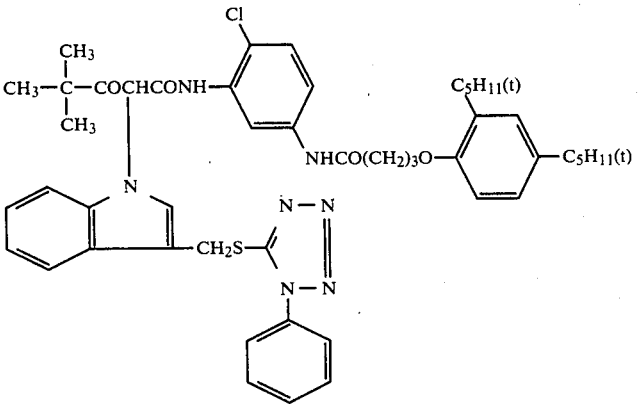
[T - 14]
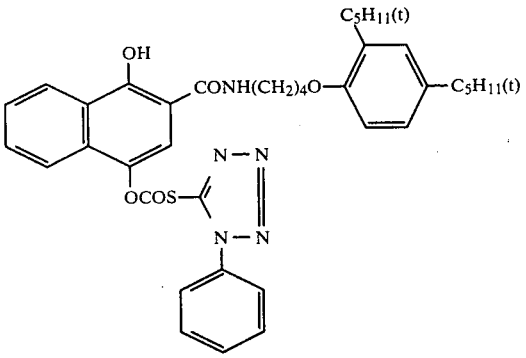

-continued
[T - 15]
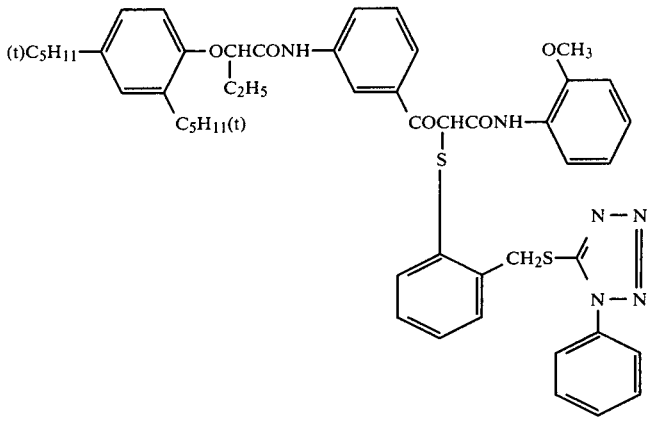
[T - 16]
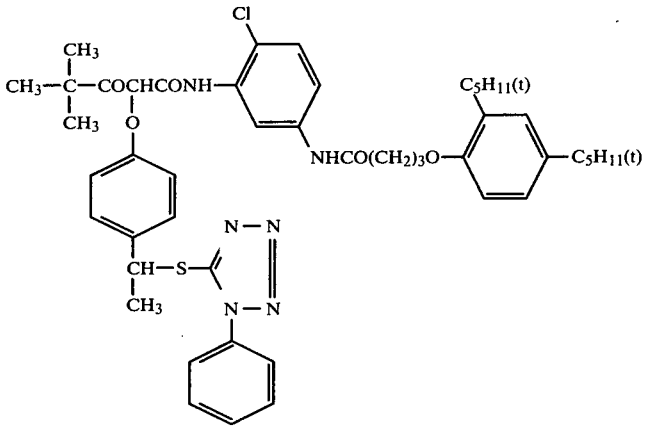
[T - 17]
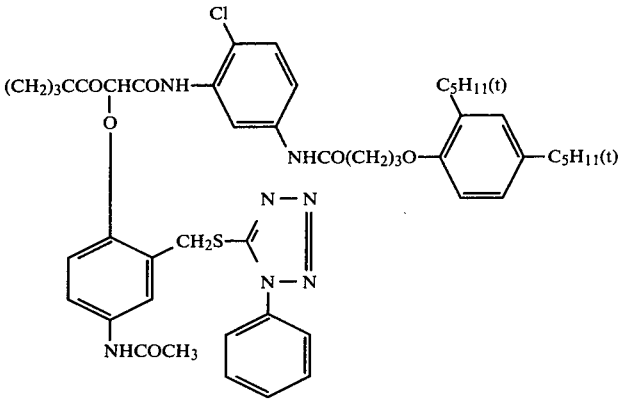

-continued
[T - 18]
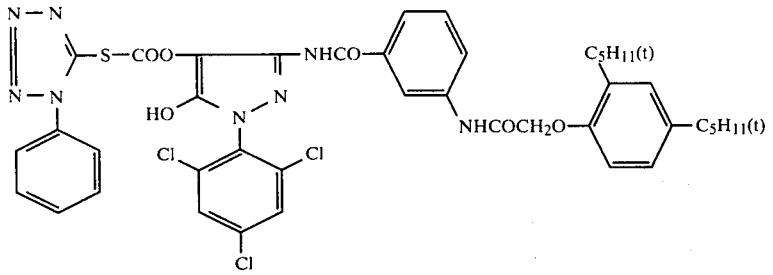
[T - 19]
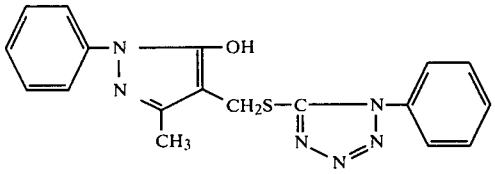
[T - 20]
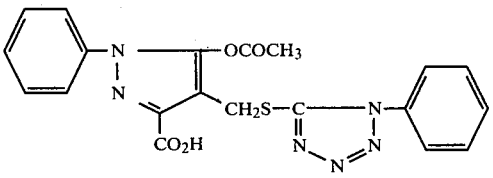
[T - 21]
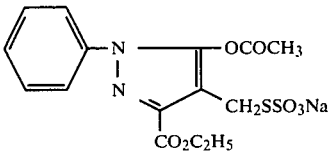
[T - 22]
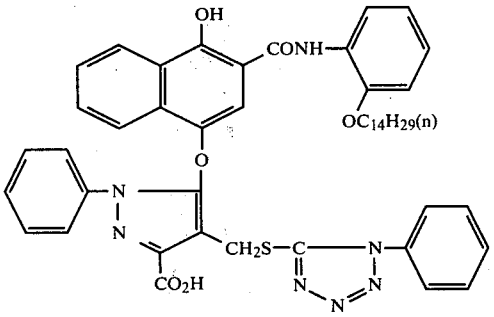
[T - 23]
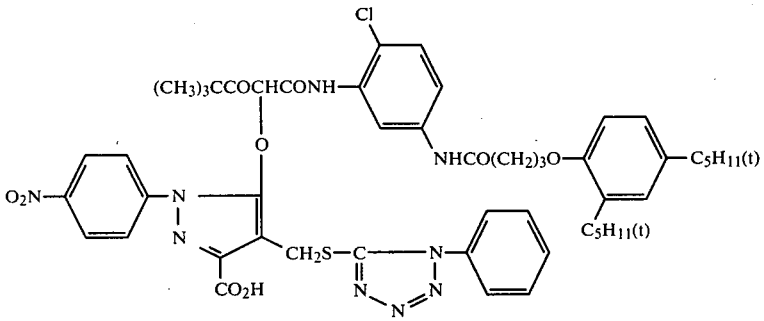

-continued
[T - 24]
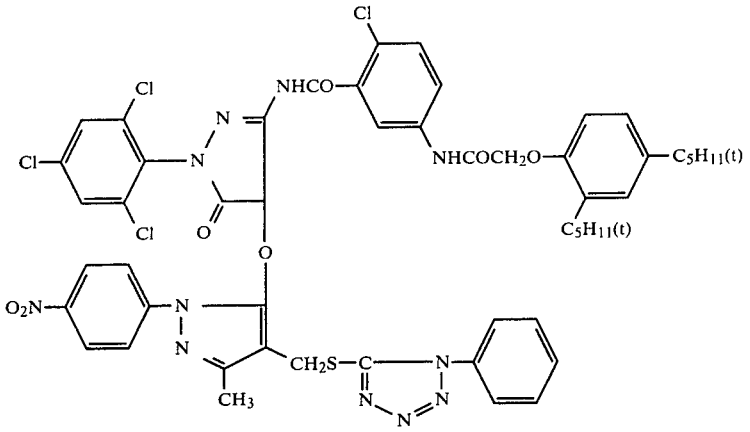
[T - 25]
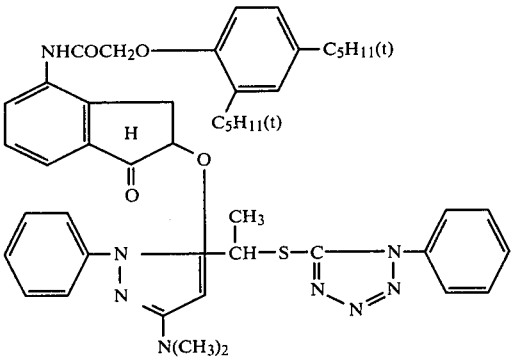
[T - 26]
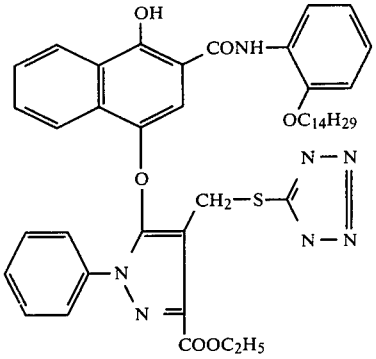
[T - 27]
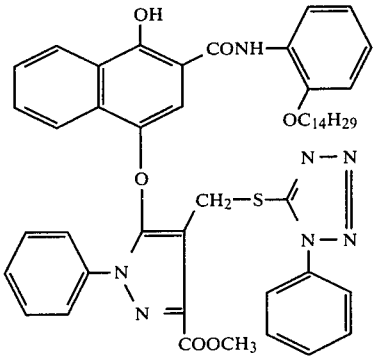
[T - 28]
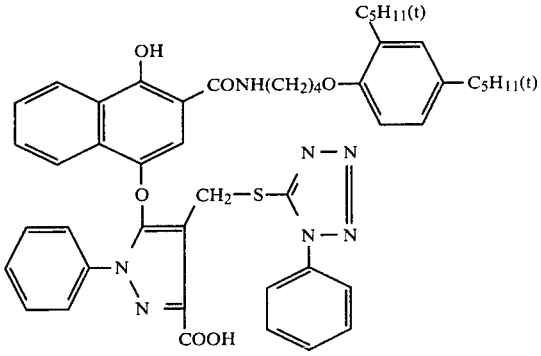

-continued
[T - 29]
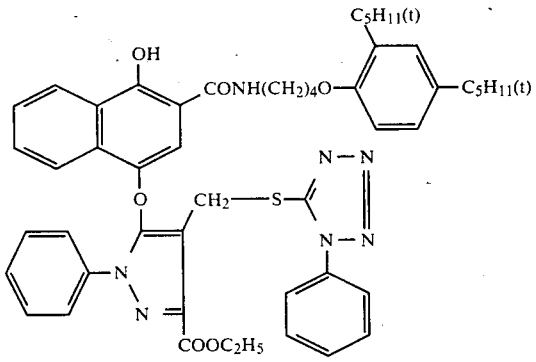
[T - 30]
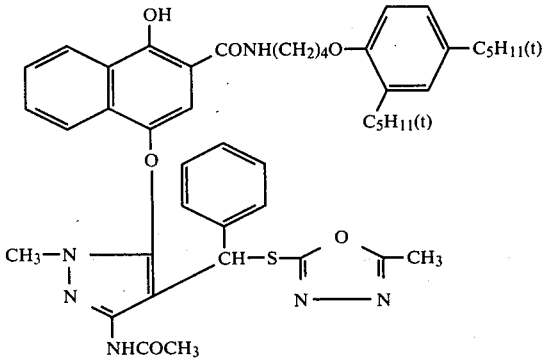
[T - 31]
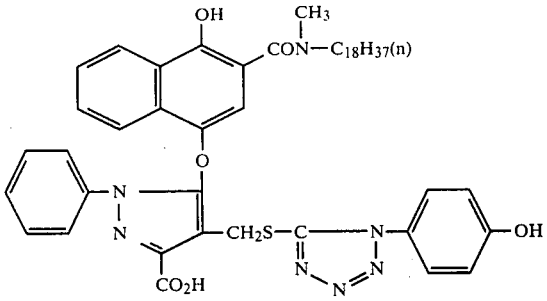
[T - 32]
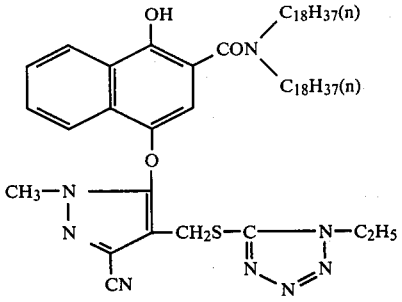
[T - 33]
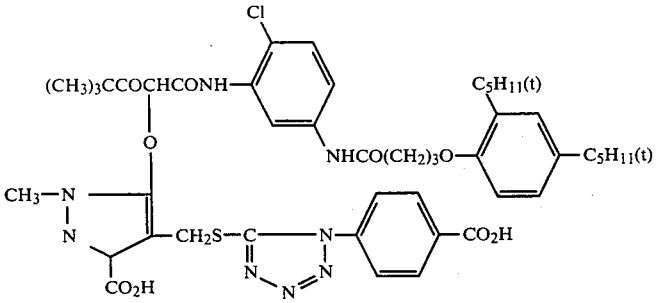
[T - 34]
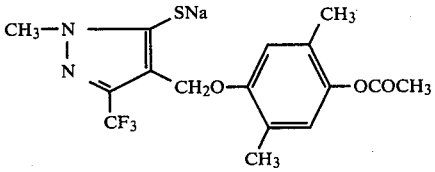
[T - 35]
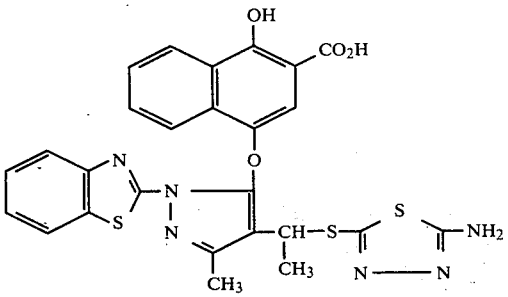
[T - 36]
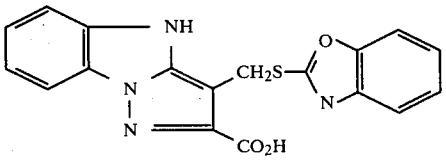

-continued
[T - 37]
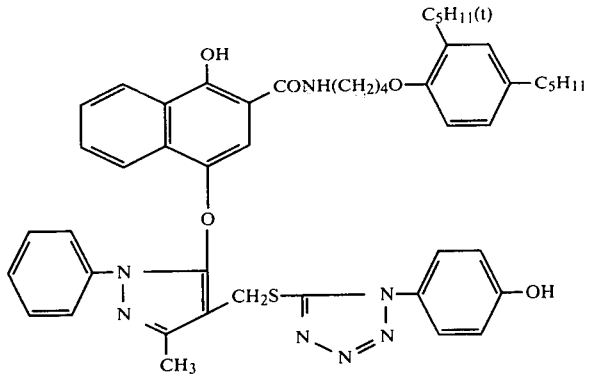
[T - 38]
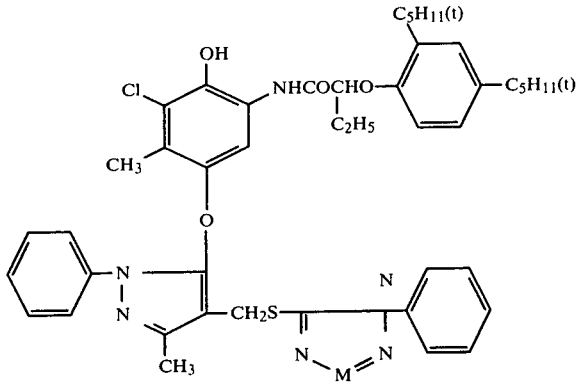
[T - 39]
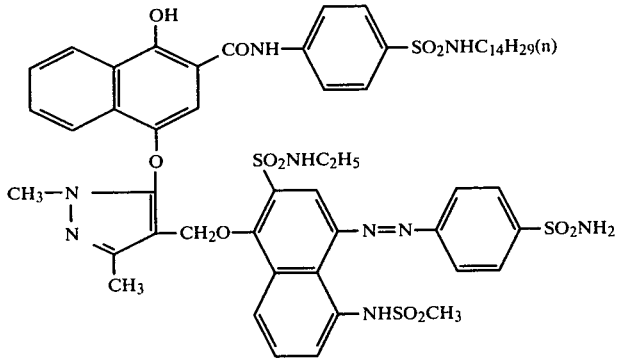
[T - 40]
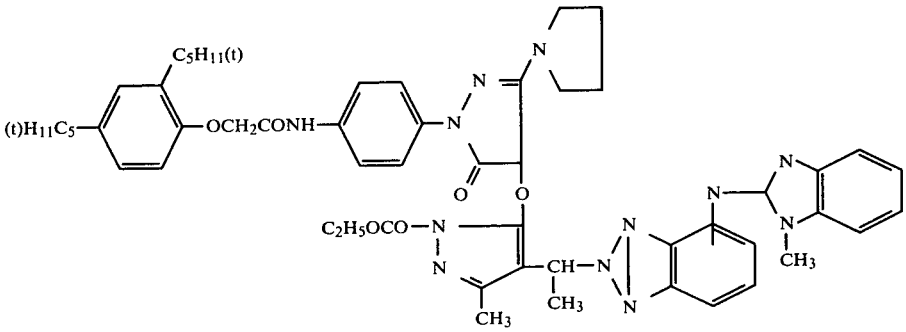

-continued
[T - 41]
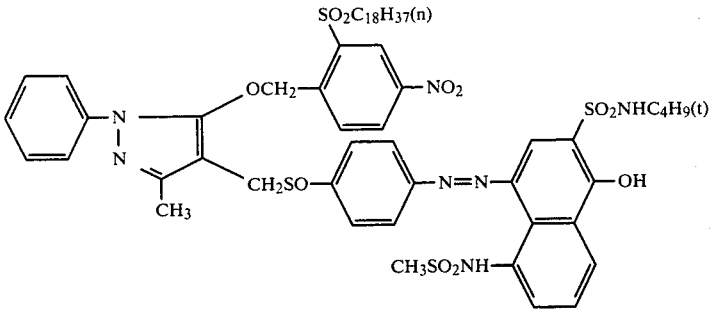
[T - 42]
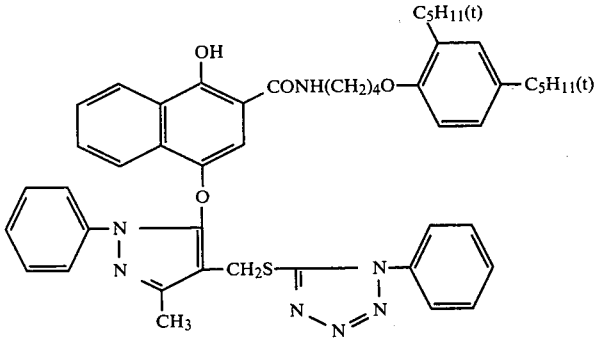
[T - 43]
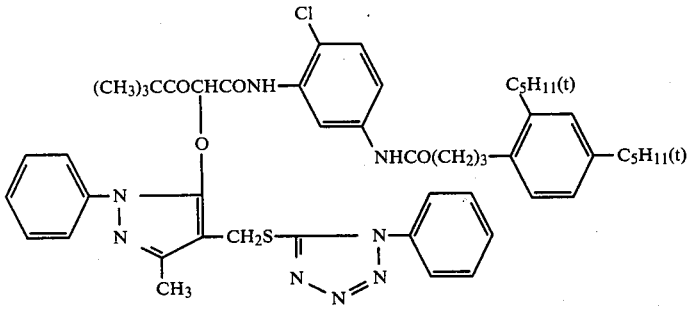
[T - 44]
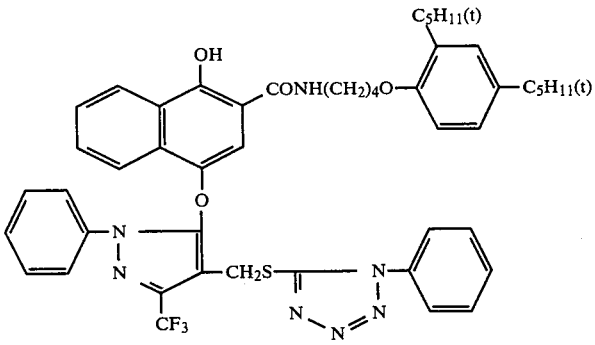

-continued
[T - 45]
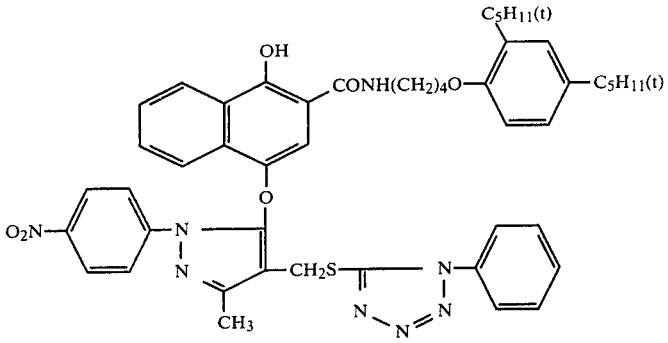
[T - 46]
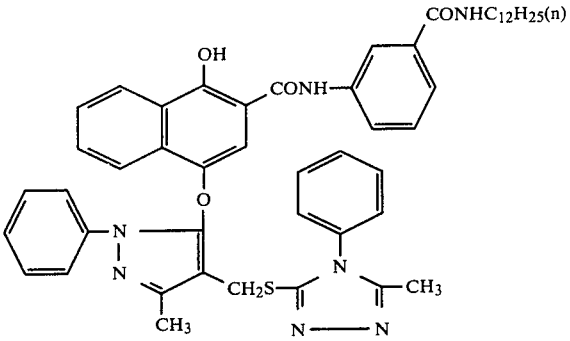
[T - 47]
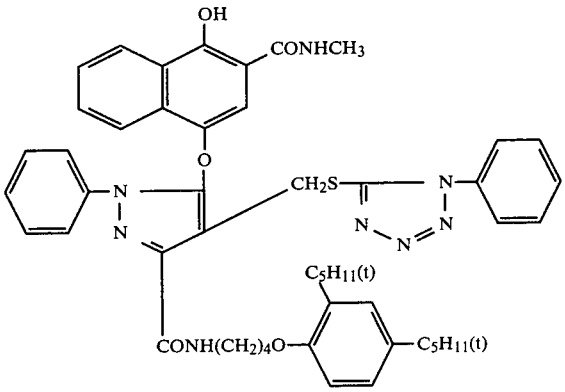
[T - 48]
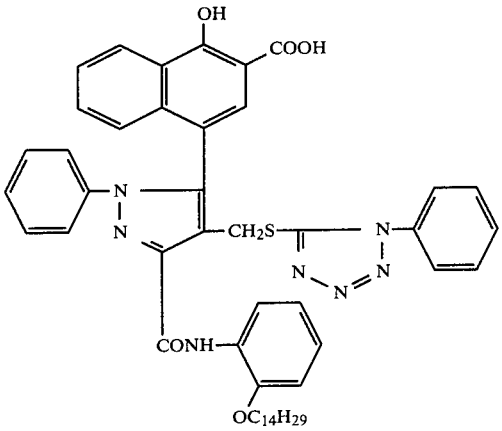
[T - 49]
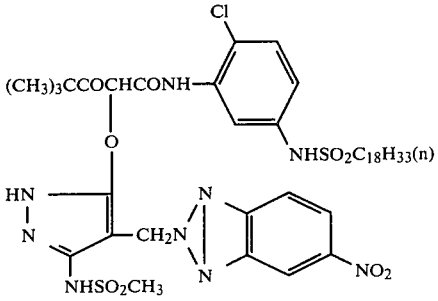
[T - 50]
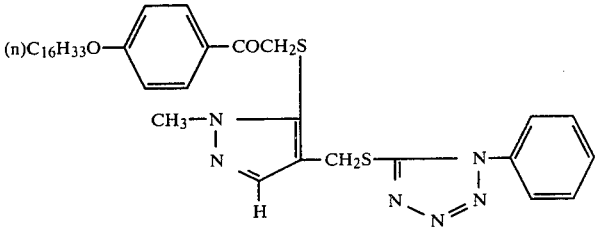

-continued
[T - 51]
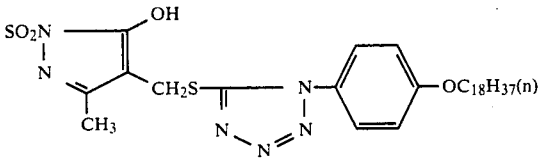
[T - 52]
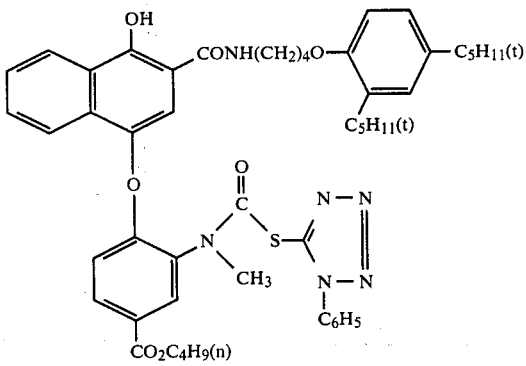
[T - 53]
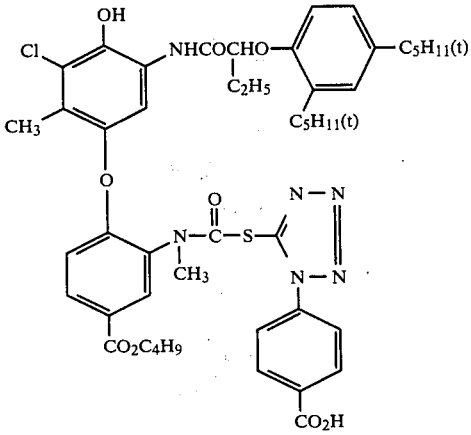
[T - 54]
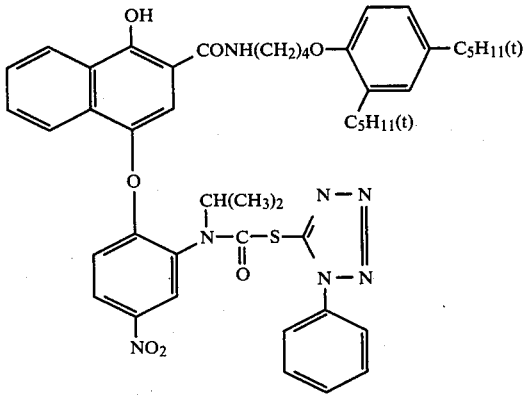
[T - 55]
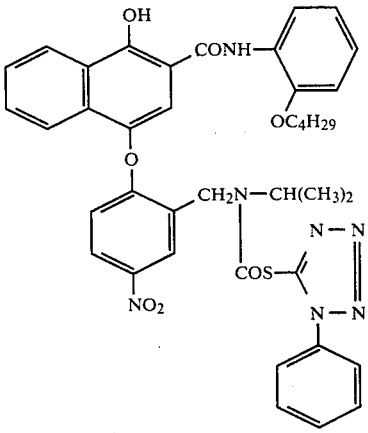
[T - 56]
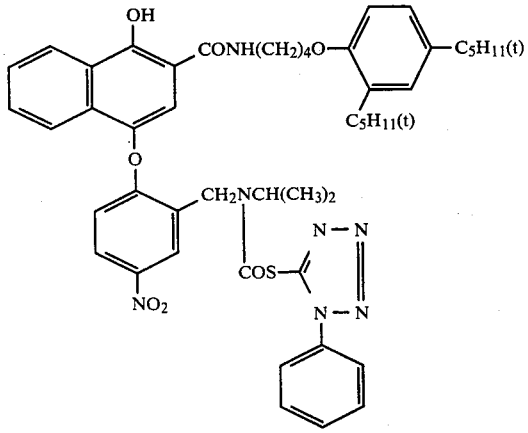

-continued
[T - 57]~[T - 64]
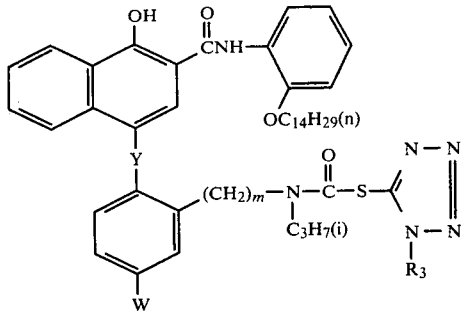
wherein Y, W, m and $R_3$ are as shown below:
| Compound No. | Y | W | m | $R_3$ |
|---|---|---|---|---|
| [T - 57] | O | $NO_2$ | 0 | 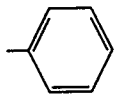 |
| [T - 58] | S | $NO_2$ | 1 | 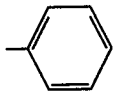 |
| [T - 59] | O | $NO_2$ | 1 | 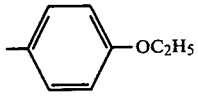 |
| [T - 60] | O | $NO_2$ | 1 | 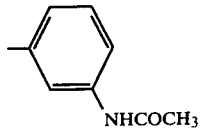 |
| [T - 61] | O | $NO_2$ | 1 | 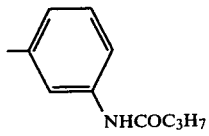 |
| [T - 62] | O | $NHSO_2C_4H_9$ | 0 | 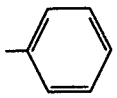 |
| [T - 63] | O | $NHSO_2C_8H_{17}$ | 1 | 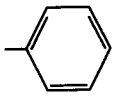 |
| [T - 64] | S | H | 0 | 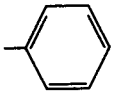 |

-continued

[T - 65]~[T - 69]

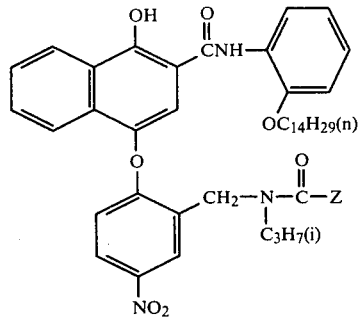

| Compound No. | Z |
|---|---|
| [T - 65] | ethylmercaptotetrazole |
| [T - 66] | n-butylmercaptotetrazole |
| [T - 67] | cyclohexylmercaptotetrazole |
| [T - 68] | N—heptylmercaptotetrazole |
| [T - 69] | 5,6-dichlorobenzotriazole |

[T - 70]

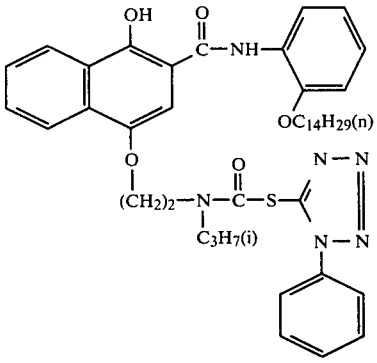

[T - 71]

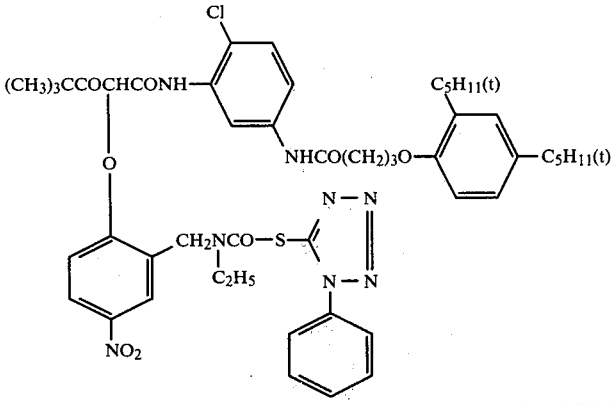

The DIR compounds having the timing groups to be used in the present invention can be synthesized according to the methods as disclosed in the specifications of Japanese Provisional Patent Publication No. 14513/1979, Japanese Patent Application No. 17644/1980 and Japanese Patent Application No. 39766/1981.

The T-DIR compounds employed in the present invention may be contained in any desired layer selected from the high sensitivity layer, the intermediate layer according to the present invention which is non-photosensitive and the low sensitivity layer. Preferably, they may be added in each of the high sensivitiy layer or the intermediate layer according to the present invention which is non-photosensitive. The T-DIR compounds may be thereby added in amounts in the range of from $5\times10^{-5}$ to $2\times10^{-2}$ mole, preferably $2\times10^{-4}$ to $5\times10^{-3}$ mole, per mole of a silver halide. When said compound is added in the intermediate layer according to the present invention, it is added in an amount in the range of from $1.0\times10^{-6}$ to $1.0\times10^{-3}$ mole/m$^2$, preferably $1.0\times10^{-5}$ to $0.5\times10^{-4}$ mole/m$^2$.

The specific feature of the present invention resides in employment of a DIR compound having a timing group as represented by formula (I) and an improved layer constitution. Unexpectedly, however, when the layer constitution of the present invention is used in combination with DIR couplers of the prior art having no TIME group as disclosed in U.S. Pat. Nos. 3,148,062 and 3,227,554 or DIR compounds as disclosed in U.S. Pat. No. 3,632,345, the effects of the present invention, especially the improvement of stability during developing cannot be obtained.

The nondiffusible couplers to be used in the present invention may include preferably those as mentioned below.

As diffusion-resistant cyan couplers, there may preferably be used phenol type compounds and naphthol type compounds, which can be selected from those disclosed in U.S. Pat. Nos. 2,369,929; 2,434,272; 2,474,293; 2,895,826; 3,253,924; 3,034,892; 3,311,476; 3,386,301; 3,419,390; 3,458,315; 3,476,563; and 3,591,383. The methods for preparation of these compounds are also described in these references.

As nondiffusible magenta couplers, there may preferably be used pyrazolone type, pyrazolotriazole type, pyrazolinobenzimidazole type and indazolone type compounds. Pyrazolone type magenta couplers may include those as disclosed in U.S. Pat. Nos. 2,600,788; 3,062,653; 3,127,269; 3,311,476; 3,419,391; 3,519,429; 3,558,318; 3,684,514; and 3,888,680; Japanese Provisional Patent Publication Nos. 19639/1974, 111631/1974, 129538/1974 and 13041/1975; and Japanese Patent Application Nos. 24690/1975, 134470/1975 and 156327/1975. Pyrazolotriazole type magenta couplers may be exemplified by those as disclosed in U.S. Pat. No. 1,247,493. As the diffusion-resistant colored magenta couplers, there may be employed those having aryl-azo-substitutions at the coupling position of colorless magenta couplers, as exemplified by those disclosed in U.S. Pat. Nos. 2,801,171; 2,983,608; 3,005,712; and 3,684,514; British Patent No. 937,621 and Japanese Provisional Patent Publication Nos. 123625/1974 and 31448/1974. Further, it is also possible to use a colored magenta coupler of the type of which the dyestuff is flown out into a treating solution by the reaction with the oxidized product of a developing agent, as disclosed in U.S. Pat. No. 3,419,391.

As nondiffusible yellow couplers, there have been heretofore frequently used open-chain ketomethylene compounds.

For example, there may be employed those generally used in the art such as benzoylacetoanilide type yellow couplers or pivaloylacetoanilide type yellow couplers. Further, there have also advantageously been used two-equivalent type yellow couplers wherein the carbon atom at the coupling position is substituted with a substituent which can be eliminated at the time of coupling reaction. These examples as well as preparations thereof are disclosed in U.S. Pat. Nos. 2,875,057; 3,265,506; 3,664,841; 3,408,194; 3,277,155; 3,447,928; and 3,415,652; Japanese Patent Publication No. 13576/1974; Japanese Provisional Patent Publication Nos. 29432/1973; 66834/1973; 10736/1973; 122335/1973; 28834/1975; and 13296/1975.

The above nondiffusible coupler is used in the present invention in amounts in the range of from $2\times10^{-3}$ to $5\times10^{-1}$ mole, preferably $5\times10^{-3}$ to $5\times10^{-2}$ mole in a high sensitivity emulsion layer, $2\times10^{-2}$ to $3\times10^{-1}$ mole in a high sensitivity emulsion layer, per mole of a silver halide in a photosensitive silver halide emulsion layer. When a coupler is added in the intermediate layer according to the present invention, it is added in an amount in the range of from $1\times10^{-6}$ to $8\times10^{-5}$ mole/dm$^2$, preferably $4\times10^{-6}$ to $3\times10^{-5}$ mole/dm$^2$. The coupler which can be incorporated in the intermediate layer according to the present invention has a coupling speed which is equal to or less than the coupler contained in a high sensitivity emulsion layer.

The nondiffusion couplers may be dispersed according to various methods such as so called alkali aqueous solution dispersing method, solid dispersing method, latex dispersing method, oil-in-water droplet type emulsion dispersing method, etc., and the method can be selected suitably depending on the chemical structure, etc. of the diffusion-resistant coupler employed.

In the present invention, the latex dispersing method or the oil-in-water droplet type emulsion dispersing method is particularly effective. These dispersing methods are well known in the art, and the latex dispersing method and its effect are described in Japanese Provisional Patent Publication Nos. 74538/1974; 59943/1976; and 32552/1979, and Research Disclosure, No. 14850, pp. 77–79, August, 1976.

Suitable latices include homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxobenzyl)]acrylamide, 2-acrylamido-2-methylpropanesulfonic acid, etc. As the oil-in-water droplet type emulsion dispersing method, there may be employed the conventional method in which hydrophobic additives such as couplers are dispersed. That is, such additives are dissolved in a single solvent or a solvent mixture selected from a high boiling organic solvent having a boiling point of 175° C. or higher such as tricresyl phosphate, dibutyl phthalate, etc. and/or a low boiling organic solvent such as ethyl acetate, butyl pripionate, etc. and the resultant solution is mixed with an aqueous gelatin solution containing a surfactant. Then, the mixture is emulsified by means of a high speed rotary mixer or a colloid mill and the resultant emulsion is added directly into a silver halide emulsion layer or the intermediate layer according to the present invention, or alternatively the emulsion after removal of the low boiling solvent in a conventional manner is added into a silver halide emulsion layer or the intermediate layer according to the present invention.

Further, non-color indicating couplers to be used in combination in the present invention may be selected from those as disclosed in British Patent Nos. 861,138; 914,145; and 1,109,963, Japanese Patent Publication No. 14033/1970, U.S. Pat. No. 3,580,722 and Mitteilungen aus den Forschungs Laboratorium in der Agfa Levelkusen, vol. 4, pp. 352–367, 1964.

As the silver halide to be used in the silver halide emulsion layer in the color photographic photosensitive material according to the present invention may include any of those employed in silver halide photographic emulsions in general such as silver chloride, silver bromide, silver chlorobromide, silver iodobromide, silver chloroiodobromide, etc.

These silver halide grains may be either coarse or fine with grain sizes which may either narrowly or broadly be distributed. The crystals of these silver halide grains may be either normal crystals or twins with a ratio of [100] face to [111] face of any desired value. Further, these silver halide grains may have a crystalline structure which is uniform from the inner portion to the outer portion or a layered structure which is different in crystalline structure between the inner and outer portions. These silver halides may also either of the type wherein latent images are formed principally on the surfaces of grains or of the type wherein they are formed internally of the grains. These silver halide grains can be prepared according to the known method conventionally used in the art.

It is preferred to use a silver halide emulsion in the present invention from which soluble salts have been removed, but it is also possible to use one containing such salts unremoved. Alternatively, there may also be employed a mixture of two or more kinds of silver halide emulsions prepared separately.

As the binder to be used in the silver halide emulsion of the color photographic photosensitive material according to the present invention, there may be used those conventionally used in the art, as exemplified by gelatin, or gelatin derivatives such as phenylcarbamylated gelatin, acylated gelatin, phthalated gelatin, etc. These binders may be used also as a compatible mixture of two or more kinds, if desired.

The silver halide photographic emulsion having the above silver halide grains dispersed in a binder solution can be sensitized with a chemical sensitizer. The chemical sensitizers which can advantageously be used in combination in the present invention can be classified broadly into four classes of noble metal sensitizers, sulfur sensitizer, selenium sensitizers and reducing sensitizers.

As noble metal sensitizers, there may be employed gold compounds or compounds or ruthenium, rhodium, palladium, iridium, platinum, etc.

When a gold compound is used, ammonium thiocyanate or sodium thiocyanate may further be used in combination.

As sulfur sensitizers, there may be employed sulfur compounds in addition to active gelatin.

As selenium sensitizers, there may be employed active or inactive selenium compounds.

Reducing sensitizers may include monovalent tin salts, polyamine, bisalkylamino sulfide, silane compounds, iminoaminomethane sulfinic acid hydrazinium salt and hydrazine derivatives.

Further, the silver halies may also be sensitized optically to a desired wavelength region. For example, optical sensitization is possible by use of a single species or a combination of two or more species of cyanine dyestuffs such as monomethyne dyestuff or trimethyne dyestuff or melocyanine dyestuffs, etc.

In the color photograpic photosensitive material of the present invention, there may be employed in addition to the additives as described above various other additives useful in photographic photosensitive materials, including, for example, stabilizers, development accelerators, film hardeners, surfactants, contamination inhibitors, lubricants, UV-absorbers, etc.

It is also possible to provide an auxiliary layer such as a protective layer, an intermediate layer, a filter layer, a halation prevention layer, a back layer, etc., if desired.

As a support, there may suitably be selected any suitable material depending on the intended purpose of the photographic photosensitive material from well known materials such as plastic film, plastic laminate papers, baryta papers, synthetic papers, etc. These supports are generally subjected to undercoating treatments for strengthening adhesion to photographic emulsion layers.

The treatment of the color photographic photosensitive material may be performed according to the method which is not particularly limited, but all treatment methods may be available. For example, typical methods include the method, comprising performing color forming development, then bleaching fixing treatment and further, if necessary, washing and stabilizing treatment; the method, comprising performing color forming development, then bleaching and fixing separately and further, if necessary, washing and stabilizing treatment; the method, comprising performing prehardening of film, neutralization, color forming, stopping fixation, washing with water, fixing, washing with water, post-hardening of film and washing with water in the order mentioned; the method, comprising performing color forming development, washing with water, supplemental color forming development, stopping, bleaching, fixing, washing with water and stabilization in the order mentioned; the developing method, comprising performing halogenation bleach of the developed silver formed by color forming development and then performing again color forming development to increase the quantity of dyestuffs produced; and the treatment method in which a photosensitive material with a low silver content is treated with an amplifier agent such as a peroxide or a cobalt complex.

Typical example of a color forming developing agent is that of p-phenylenediamine type.

It is also possible to use a color forming developing agent added in a color photographic photosensitive material. As precursors of color forming developing agents to be used in the present invention, there may be employed Schiff base type of color developing agents disclosed in U.S. Pat. Nos. 2,507,114; 2,695,234; and 3,342,599, Research Disclosure, vol. 151, No. 15159, Nov. 1979, as well as those disclosed in Research Disclosure vol. 129, No. 12924, Oct. 1976, vol. 121, No. 12146 Jun. 1974 and vol. 139, No. 13924, Nov. 1975.

It is also possible to add various additives to the color forming developer, if necessary.

The present invention is further described by referring to the following Examples, by which the present invention is not limited.

EXAMPLE 1

The respective layers shown below were provided by coating on a support of a cellulose triacetate film subjected to undercoating treatment successively from the side of the support to prepare Sample 1.

Layer-1

Red Photosensitive Low Sensitivity Silver Halide Emulsion Layer

A silver iodobromide emulsion containing 4 mole% of silver iodide (average grain size: 0.7μ, containing 0.25 mole of silverhalide and 40 g of gelatin per 1 kg of emulsion) was prepared by a conventional method. One kilogram of the emulsion was chemically sensitized with gold and a sulfur sensitizer, and further there were added as red photosensitive sensitizing dyestuffs anhydrous 9-ethyl-3,3'-di-(3-sulfopropyl)-4,5,4',5'-dibenzothiacarbocyanine hydroxide, anhydrous 5,5'-dichloro-9-ethyl-3,3'-di-(3-sulfopropyl)thiacarbocyanine hydroxide, anhydrous 5,5'-dichloro-3',9-diethyl-3-(4-sulfobutyl)oxythiacarbocyanine hydroxide, and then 0.25 g of 4-hydroxy-6-methyl-1,3,3a,7-tetrazaindene, 20 mg of 1-phenyl-5-mercaptotetrazole, and 0.2 g of polyvinyl pyrrolidone, followed further by addition of 500 ml of the dispersion (C-1) shown below. The thus prepared red photosensitive low sensitivity silver halide emulsion was coated to a dry film thickness of 3.0μ.

Layer-2

Red Photosensitive High Sensitivity Silver Halide Emulsion Layer

A silver iodobromide emulsion containing 7 mole% of silver iodide (average grain size: 1.2μ, containing 0.25 mole of silver halide and 30 g of gelatin per 1 kg of emulsion) was prepared by a conventional method. One kilogram of the emulsion was chemically sensitized with gold and a sulfur sensitizer, and further there were added as red photosensitive sensitizing dyestuffs anhydrous 9-ethyl-3,3'-di-(3-sulfopropyl)-4,5,4',5'-dibenzothiacarbocyanine hydroxide, anhydrous 5,5'-dichloro-9-ethyl-3,3'-di-(4-sulfopropyl)thiacarbocyanine hydroxide, anhydrous 5,5'-dichloro-9-ethyl-3,3'-di-(4-sulfobutyl)oxathiacarbocyanine hydroxide, and then 0.25 g of 4-hydroxy-6-methyl-1,3,3a,7-tetrazaindene, 8 mg of 1-phenyl-5-mercaptotetrazole, and 0.2 g of polyvinyl pyrrolidone, followed further by addition of 500 ml of the dispersion (C-2) shown below. The thus prepared red photosensitive high sensitivity silver halide emulsion was coated to a dry film thickness of 2.0μ.

The dispersions used in the above respective emulsion layers were prepared as follows:

Dispersion (C-1)

In a mixture of 55 g of tricresyl phosphate (hereinafter referred to as TCP) and 110 ml of ethyl acetate (hereinafter referred to as EA), there were dissolved under heating 50 g of a coupler 1-hydroxy-N-[δ-(2,4-di-t-amylphenoxy)butyl]-2-naphthoamide (Coupler 1) and 4 g of a colored cyan coupler 1-hydroxy-4-[4-(1-hydroxy-8-acetoamido-3,6-disulfo-2-naphthylazo)-phenoxy]-N-[δ-(2,4-di-t-amylphenoxy)butyl]-2-naphthoamide disodium salt, and the resultant mixture was added to 400 ml of a 7.5% aqueous gelatin solution containing 4 g of sodium triisopropylnaphthalene sulfonate, followed by emulsification in a colloid mill, to make up 1000 ml of a dispersion.

Dispersion (C-2)

In a mixture of 20 g of TCP and 50 ml of EA, there were dissolved under heating 10 g of a cyan coupler 1-hydroxy-4-(β-methoxyethylaminocarbonylmethoxy)-N-[δ-(2,4-di-t-amylphenoxy)butyl]-2-naphthoamide (Coupler 2), and the resultant mixture was added to 400 ml of a 7.5% aqueous gelatin solution containing 4 g of sodium triisopropylnaphthalene sulfonate, followed by emulsification in a colloid mill, to make up 1000 ml of a dispersion.

The Sample 1 was prepared as described above, and further Sample 2 was prepared in the same manner as in preparation of Sample 1 except that the cyan coupler dispersions as indicated in Table 1 below were added or replaced in the layer of Sample 2 to give Samples 2 to 3. There were also prepared Samples 4 to 7 in which the intermediate layer according to the present invention were provided between the first layer and the second layer (Samples 4 to 5 were prepared by coating of the aqueous gelatin solution to a dry film thickness of 1.0μ, and Samples 6 to 7 prepared similarly as Layer-2 with a silver iodobromide containing 6 mole% of silver iodide with ann average particle size of 0.7μ, with proviso that the dispersion C-3 was employed for Sample 6 and the dispersion C-5 for Sample 7). The dispersions C-3 to C-4 were prepared as follows:

Dispersion (C-3)

This dispersion was prepared in the same manner as in dispersion (C-2) except that 0.1 g of DIR compound (D-1) was added.

Dispersion (C-4)

This dispersion was prepared in the same manner as the dispersion C-2 except that 0.15 g of T-DIR compound (T-42) was added.

D-1:
2-(1-phenyl-5-tetrazolylthio)-4-octadecylsuccinimide-1-indanone

Layer-3

Intermediate Layer

An aqueous gelatin solution was coated to a dry film thickness of 1.0μ.

Layer-4

Green Photosensitive Low Sensitivity Silver Halide Emulsion Layer

A silver iodobromide emulsion containing 6 mole% of silver iodide (average grain size: 0.3μ, containing 0.25 mole of silver halide and 40 g of gelatin per 1 kg of emulsion) was prepared by a conventional method. One kilogram of the emulsion was chemically sensitized with gold and a further sensitizer, and further there were added as green photosensitive sensitizing dyestuffs anhydrous 5,5'-dichloro-9-ethyl-3,3'-di-(3-sulfopropyl-)oxacarbocyanine hydroxide, anhydrous 5,5'-diphenyl-9-ethyl-3,3'-di(3-sulfopropyl)oxacarbocyanine; anhydrous 9-ethyl-3,3'-di-(3-sulfopropyl)-5,6,5',6'-dibenzooxacarbocyanine hydroxide; and then 0.25 g of 4-hydroxy-6-methyl-1,3,3a,7-tetrazaindene, 20 mg of 1-phenyl-5-mercaptotetrazole, and 0.2 g of polyvinyl pyrrolidone to prepare a sensitized sensitizer emulsion A. Separately, a silver iodobromide emulsion containing 6 mol% of silver iodide (average grain size: 0.7μ, containing 0.25 mol of silver halide and 40 g of gelatin per 1 kg of emulsion) was prepared by a conventional method and sensitized similarly as the sensitized emulsion A by the same method except for use of half amounts of sensitizer and stabilizer to prepare another sensitized emulsion B. Both emulsions were mixed, followed by addition of 500 ml of the dispersion (M-1) shown below to 1 kg of the resultant mixed solution. The thus prepared green photosensitive low sensitivity silver halide emulsion was coated to a dry film thickness of 3.0μ.

Layer-5

Green Photosensitive High Sensitivity Silver Halide Emulsion Layer

A silver iodobromide emulsion containing 7 mole% of silver iodide (average grain size: 1.2μ, containing 0.25 mole of silver halide and 30 g of gelatin per 1 kg of emulsion) was prepared by a conventional method. One kilogram of the emulsion was chemically sensitized with gold and a sulfur sensitizer, and further there were added as green photosensitive sensitizing dyestuffs anhydrous 5,5'-dichloro-9-ethyl-3,3'-di-(3-sulfopropyl)oxacarbocyanine hydroxide, anhydrous 5,5'-diphenyl-9-ethyl-3,3'-di(3-sulfopropyl)oxacarbocyanine; anhydrous 9-ethyl-3,3'-di-(3-sulfopropyl)-5,6,5',6'-dibenzooxacarbocyanine hydroxide; and then 0.25 g of 4-hydroxy-6-methyl-1,3,3a,7-tetrazaindene, 5 mg of 1-phenyl-5-mercaptotetrazole, and 0.2 g of polyvinyl pyrrolidone. To the resultant mixture, 200 ml of the dispersion (M-2) shown below was added. The thus prepared green photosensitive high sensitivity silver halide emulsion was coated to a dry film thickness of 2.0μ.

The dispersions used in the above emulsion were prepared by the following methods.

Dispersion (M-1)

A solution of 54 g of the aforesaid magenta coupler 1-(2,4,6-trichlorophenyl)-3-(3-(2,4-di-t-amylphenoxyacetamido)benzamide)-5-pyrazolone (Coupler 3) and 14 g of a colored magenta coupler (CM-2) dissolved in a mixture of 68 g of TCP and 280 ml of EA was added to 500 ml of a 7.5% gelatin containing 8 g of sodium triisopropylnaphthalene sulfonate and emulsified in a colloid mill to prepare 1000 ml of a dispersion.

Dispersion (M-2)

A solution of 30 g of the aforesaid magenta coupler (Coupler 3) and 12 g of a colored magenta coupler 1-(2,4,6-trichlorophenyl)-4-(1-naphthylazo)-3-(2-chloro-5-octadecenylsuccinimidoanilino)-5-pyrazolone dissolved in a mixture of 70 g of TCP and 280 ml of EA was added into 500 ml of a 7.5% gelatin containing 8 g of sodium triisopropylnaphthalene sulfonate, and emulsified in a colloid mill to prepare 1000 ml of a dispersion.

Layer-6

Yellow Filter Layer

A gelatin layer containing yellow colloid silver and 2,5-di-tert-octylhydroquinone was coated to a dry film thickness of 1μ.

Layer-7

To the silver halide emulsion used in the Layer-6, there were added as yellow coupler $3\times10^{-1}$ mole of α-pivaloyl-(1-benzyl-2-phenyl-3,5-dioxytriazolidin-4-yl)-5'-[α-(2,4-di-tert-amylphenoxy)butylamide]-2'-chloroacetoanilide and, using 1,2-bis(vinylsulfonyl)ethane as film hardening agent, coating with a dry film thickness of 6μ was formed.

Layer-8

As a matting agent, an aqueous gelatin solution containing silica with particle sizes of 5μ was coated to a dry film thickness of 1.0μ.

These Samples were exposed to white light through an optical wedge and treated according to the following treatment steps:

| Treatment steps (38° C.) | Treatment time |
|---|---|
| Color forming development | 3 min. 15 sec. |
| Bleaching | 6 min. 30 sec. |
| Washing with water | 3 min. 15 sec. |
| Fixation | 6 min. 30 sec. |
| Washing with water | 3 min. 15 sec. |
| Stabilization | 1 min. 30 sec. |

The treating solutions employed in respective solutions had the following composition:

| Composition of color forming developer: | |
|---|---|
| 4-Amino-3-methyl-N—ethyl-N—(β-hydroxyethyl)-aniline sulfate | 4.8 g |
| Anhydrous sodium sulfite | 0.14 g |
| Hydroxyamine ½ sulfate | 1.98 g |
| Sulfuric acid | 0.74 g |
| Anhydrous potassium carbonate | 28.85 g |
| Anhydrous potassium hydrogen carbonate | 3.46 g |
| Anhydrous potassium sulfite | 5.10 g |

-continued

| | |
|---|---|
| Potassium bromide | 0.10 g |
| Sodium chloride | 0.14 g |
| Nitrilotriacetic acid trisodium salt (mono-hydrate) | 1.20 g |
| Potassium hydroxide | 1.48 g |
| Water added to make up 1 liter | |
| Composition of bleaching solution: | |
| Ferric ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 ml |
| Water added to make up 1 liter and adjusted to pH 6.0 with ammoniacal water. | |
| Composition of fixing solution: | |
| Ammonium thiosulfate | 175.0 g |
| Anhydrous sodiumsulfite | 8.6 g |
| Sodium methasulfite | 2.3 g |
| Water added to make up 1 liter and adjusted to pH 6.0 with acetic acid. | |
| Composition of stabilizing solution: | |
| Formalin (37% aqueous solution) | 1.5 ml |
| Konidax (produced by Konishiroku Photo Industry Co., Ltd., Japan) | 7.5 ml |
| Water added to make up 1 liter. | |

As the next step, sensitivity, graininess and development stability were measured for color images formed on each of the above Samples to obtain the results as shown in Table 1.

The graininess in the image forming unit layer shown in Table 1 is a value measured when white light exposure was given and graininess (RMS) is represented in terms of 1000 times the standard deviation value of fluctuations of density values on scanning by a microdensitometer with a circular scanning orifice diameter of 2.5μ.

The development stability was measured from a percentage ratio of $\gamma_s/\gamma_o\times100(\%)$ of a gamma value ($\gamma_o$) under the above developing conditions and the gamma value ($\gamma_s$) under the development time shorter by 20 seconds than said conditions (2 min. 55 sec.), indicating that the development is better as the percentage ratio is nearer to 100(%).

The sensitivity was represented as a relative value based on the sensitivity value as 100 of the image forming unit layer of Sample 1 subjected to white light exposure.

TABLE 1

| Sample No. | Dispersion added in high sensitivity layer | Intermediate layer according to the present invention | Dispersion added in low sensitivity layer | Characteristics of cyan color forming layer | | |
|---|---|---|---|---|---|---|
| | | | | Sensitivity | Graininess (RMS) | Development stability (%) |
| 1 (outside of invention) | C - 1 | — | C - 2 | 100 | 75 (inferior) | 75 (inferior) |
| 2 (same as above) | C - 3 | — | " | 85 | 65 (inferior) | 72 (inferior) |
| 3 (same as above) | C - 4 | — | " | 100 | 60 (inferior) | 78 (inferior) |
| 4 (same as above) | C - 3 | Gel | " | 85 | 45 (good) | 76 (inferior) |
| 5 (present invention) | C - 4 | " | " | 100 | 40 (good) | 89 (good) |
| 6 (outside of invention) | C - 3 | medium sensitivity silver halide emulsion + C - 3 | " | 85 | 45 (good) | 76 (inferior) |

TABLE 1-continued

| Sample No. | Dispersion added in high sensitivity layer | Intermediate layer according to the present invention | Dispersion added in low sensitivity layer | Characteristics of cyan color forming layer | | |
|---|---|---|---|---|---|---|
| | | | | Sensitivity | Graininess (RMS) | Development stability (%) |
| 7 (present invention) | C - 4 | medium silver halide emulsion + C - 4 | " | 100 | 40 (good) | 83 (good) |

As apparently seen from the results in Table 1, Samples No. 5, 7 of the present invention exhibited excellent graininess as well as developing stability without imparing sensitivity, as compared with Comparative Samples No. 1 to 4 and No. 6, which are outside the scope of the present invention. Such effects can be entirely unexpected from the level of the prior art.

EXAMPLE 2

The following layers were coated on a support subjected to undercoating of a cellulose triacetate film successively from the side of the support to prepare Sample 7.

Layer-1: Red photosensitive low sensitivity silver halide emulsion layer: same as the Layer-1 as described in Example 1 except for use of the Dispersion (C-6).

Dispersion (C-6): dispersed and prepared similarly as Dispersion (C-1) except that 0.5 g of DIR compound (D-1) was added.

Layer-2: Intermediate layer according to the present invention prepared by coating of an aqueous gelatin solution to a dry film thickness of 1.0μ.

Layer-3: Red photosensitive high sensitivity silver halide emulsion: same as the Layer-2 as described in Example 1 except for use of Dispersion-7.

Dispersion (C-7) dispersed and prepared similarly as Dispersion (C-3) except for addition of 10 g of cyan coupler (Coupler 1/Coupler 2=¼ molar ratio) in place of Coupler 2.

Sample 7 was thus prepared and further to Layers-1, 2 and Layer-3 of Sample 7, there were added or replaced cyan coupler dispersions as indicated in Table 2 to prepare Samples 8 to 10 (the medium sensitivity silver halide emulsion as described in Example 1 was added to the intermediate layer of Sample 9).

The dispersions employed in Samples 8 to 10 were prepared according to the following procedures:

Dispersion (C-8): dispersed and prepared similarly as Dispersion (C-1) except for addition of 0.1 g of T-DIR compound (T-42).

Dispersion (C-9): dispersed and prepared similarly as Dispersion (C-4) except for addition of 10 g of a cyan coupler (Coupler 1/Coupler 2=¼ molar ratio) in place of Coupler 2.

Dispersion (C-10): dispersed and prepared similarly as Dispersion (C-9) except for addition of 0.10 g of T-DIR compound (T-42) and 0.02 g of (T-4) in place of 0.15 g of T-DIR compound (T-42).

Dispersions employed in Samples 9 to 10 were added by coating in amounts of 11.3 mol/cm$^2$ to a dry film thickness of 1.0μ.

| | |
|---|---|
| Layer - 4 | Layer - 3 as described in Example 1 |
| Layer - 5 | Layer - 4 as described in Example 1 |
| Layer - 6 | Layer - 5 as described in Example 1 |
| Layer - 7 | Layer - 6 as described in Example 1 |
| Layer - 8 | Layer - 7 as described in Example 1 |
| Layer - 9 | Layer - 8 as described in Example 1 |

White light exposure was applied on these Samples and treatments were conducted similarly as described in Example 1.

Then, sensitivity, graininess and developing stability were measured for cyan images formed on respective Samples. The results are shown in Table 2. The measurement methods employed were the same as in Example 1.

As apparently seen from the results in Table 2, Samples No. 8 to 10 of the present invention exhibited excellent graininess as well as developing stability without impairing sensitivity, as compared with Comparative Sample No. 7 outside of the scope of the present invention.

When T-DIR compounds, T-54, 55 and 70 were employed in place of the exemplary compounds T-4, 42, the same results as in Example 2 were obtained.

TABLE 2

| Sample No. | Dispersion added in high sensitivity layer | Intermediate layer according to the present invention | Dispersion added in low sensitivity layer | Characteristics of cyan color forming layer | | |
|---|---|---|---|---|---|---|
| | | | | Sensitivity | Graininess (RMS) | Development stability (%) |
| 7 (outside of invention) | C - 7 | Gel | C - 6 | 85 | 45 (good) | 75 (inferior) |
| 8 (present invention) | C - 9 | Gel | C - 8 | 100 | 40 (good) | 87 (good) |
| 9 (same as above) | C - 9 | medium sensitivity silver halide emulsion + C - 9 | C - 8 | 100 | 45 | 83 (good) |
| 10 (same as | C - 10 | C - 10 | C - 8 | 100 | 45 | 90 (good) |

TABLE 2-continued

| Sample No. | Dispersion added in high sensitivity layer | Intermediate layer according to the present invention | Dispersion added in low sensitivity layer | Characteristics of cyan color forming layer | | |
|---|---|---|---|---|---|---|
| | | | | Sensitivity | Graininess (RMS) | Development stability (%) |
| above) | | | | | | |

I claim:

1. A silver halide color photographic photosensitive material, comprising a red light-sensitive emulsion layer, a green light-sensitive emulsion layer and a blue light-sensitive emulsion layer on a support, each emulsion containing a nondiffusible image forming coupler, being characterized in that at least one of the red light-sensitive emulsion layer, the green light-sensitive emulsion layer and the blue light-sensitive emulsion layer is separated into a high sensitivity silver halide emulsion layer and a low sensitivity silver halide emulsion layer, both layers having photosensitive regions in substantially the same spectral region, by an intermediate layer, and at least one DIR compound represented by formula (I) shown below is incorporated in at least one layer of said high sensitivity silver halide emulsion layer, said low sensitivity silver halide emulsion and the intermediate layer:

A-TIME-Z (I)

wherein A is a coupling component capable of reacting with an oxidized product of a color forming developing agent and releasing a TIME-Z group on reaction with an oxidized product of a color forming developing agent; TIME is a timing group; and Z is a development inhibitor.

2. The silver halide color photographic photosensitive material according to claim 1, wherein the DIR compound is represented by formula (II):

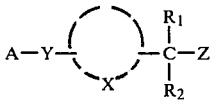

(II)

wherein A and Z have the same meanings as defined in formula (I), X represents a group of atoms necessary for completion of a benzene ring or a naphthalene ring; each of $R_1$ and $R_2$ represents a hydrogen atom, an alkyl group or an aryl group; and Y represents —S—, —O— or

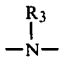

($R_3$ represents a hydrogen atom, an alkyl group, an acyl group, sulfonic group, or may form a condensed ring together with $R_1$, said group of

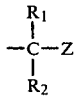

being substituted at the ortho- or para-position relative to Y).

3. The silver halide color photographic photosensitive material according to claim 1, wherein the DIR compound is represented by formula (III):

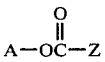

(III)

wherein A and Z have the same meanings as defined in formula (I).

4. The silver halide color photographic photosensitive material according to claim 1, wherein the DIR compound is represented by formula (IV):

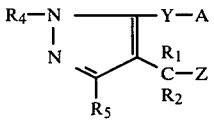

(IV)

wherein A and Z have the same meanings as defined in formula (I); Y, $R_1$ and $R_2$ have the same meanings as defined in formula (II); $R_4$ is a hydrogen atom, an alkyl group, an aryl group, an acyl group, a sulfonic acid group, an alkoxycarbonyl group or a heterocyclic residue; and $R_5$ is a hydrogen atom, an alkyl group, an aryl group, an alkoxy group, an amino group, an acidamide group, a sulfonamide group, a carboxyl group, an alkoxycarbonyl group, a carbamoyl group, or a cyano group.

5. The silver halide color photographic photosensitive material according to claim 1, wherein the DIR compound is represented by formula (V):

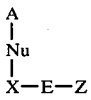

(V)

wherein A and Z have the same meanings as defined in formula (I) and Nu-X-E corresponds to TIME, Nu being a nucleophilic group having an oxygen atom, a sulfur atom or a nitrogen atom; E an electrophilic group having a carbonyl group, a thiocarbonyl group, a phosphinyl group or a thiophosphinyl group, which electrophilic group being bonded to Z; and X is a bonding group which binds Nu and E in steric association with each other and can liberate Z after liberation of Nu from A through an intramolecular nucleophilic substitution reaction with formation of a three- to seven-membered ring.

6. The silver halide color photographic photosensitive material according to claim 5, wherein the DIR compound represented by formula (V) is selected from those, wherein Nu is —O—, —S— or $>NR_3$, X is

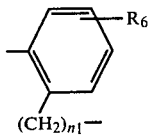

($n_1$=0 or 1) or —$(CH_2)_{n2}$— ($n_2$=2 or 3) and E is

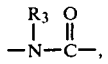

$R_6$ being a hydrogen atom, an alkyl group, an aryl group, an alkoxy group, an amide group, a carboxyl group, an alkoxycarbonyl group, a carbamoyl group, a cyano group, a nitro group or a halogen atom.

7. The silver halide color photographic photosensitive material according to claim 1, wherein the DIR compound is added in the intermediate layer.

8. The silver halide color photographic photosensitive material according to claim 7, wherein the DIR compound is added in an amount of $1.0\times10^{-5}$ to $0.5\times10^{-4}$ mole/$m^2$.

9. The silver halide color photographic photosensitive material according to claim 1, wherein the DIR compound is added in an amount of $2\times10^{-4}$ to $5\times10^{-3}$ mole per mole of silver halide.

* * * * *